United States Patent [19]

Blum

[11] Patent Number: 4,472,109

[45] Date of Patent: Sep. 18, 1984

[54] PUMP UNIT

[76] Inventor: Albert Blum, Scheiderhöhe, 5204 Lohmar 1, Fed. Rep. of Germany

[21] Appl. No.: 388,215

[22] Filed: Jun. 14, 1982

[30] Foreign Application Priority Data

Jun. 20, 1981 [DE] Fed. Rep. of Germany ..... 3124309

[51] Int. Cl.[3] ..... F04D 29/08

[52] U.S. Cl. ..... 415/170 A; 415/170 R

[58] Field of Search ..... 415/121 B, 170 A, 170 R, 415/172 R

[56] References Cited

U.S. PATENT DOCUMENTS

| | | | |
|---|---|---|---|
| 2,066,505 | 1/1937 | Wolfe | 415/172 R |
| 3,068,801 | 12/1962 | Murray | 415/170 A |
| 3,076,412 | 2/1963 | Harker et al. | 415/172 |
| 3,814,551 | 6/1974 | Weis | 415/121 |

*Primary Examiner*—Stephen Marcus

*Assistant Examiner*—John T. Kwon

*Attorney, Agent, or Firm*—Diller, Ramik & Wight

[57] ABSTRACT

A pump unit comprises an electric motor (11) and a centrifugal pump coupled thereto, whose pump impeller (14) is located on an extension of the motor shaft projecting into the pump casing (13) and has annular sealing members (141) on the back facing the motor (11) which, on delivering sewage or similar liquids, prevent the penetration of filamentary or fibrous constituents contained in the flow medium into the space behind the pump impeller (14). The annular sealing members, which are movable relative to one another, have on their periphery axially directed and preferably corrugated or sawtooth or trapezoidal profiling. The axially projecting corrugations or the like can preferably run round the periphery and the profiled edge portion of one ring can be at least substantially covered by the unprofiled edge portion of the other ring.

8 Claims, 2 Drawing Figures

PUMP UNIT

This invention relates to a pump unit formed from an electric motor and a centrifugal pump coupled thereto, whose pump impeller is located on an extension of the motor shaft projecting into the pump casing and which has on its rear side facing the motor annular sealing members which, on delivering sewage, prevent the filamentary or fibrous constituents contained in the flow medium from entering the space behind the pump impeller.

When operating such pump units difficulties particularly occur owing to the fact that constituents contained in the flow medium can be deposited between the parts rotating relative to one another, either through jamming in the sealing gap or through being deposited on the facing surfaces of the sealing gap and gradually building up to form layers which fill the gap and consequently jam the pump impeller.

In order to eliminate these problems, it is known to provide the annular sealing members with acute-angled slots, grooves and the like, which co-operate in shear-like manner and crush penetrating foreign bodies. Quite apart from the power required for the crushing, such crushing members have the deficiency that their cutting capacity decreases over a period of time due to wear and this aids the jamming effect.

The present invention aims to provide a pump unit of the aforementioned type, in which the aforementioned problems are avoided and in which there is no need for crushing the constituents contained in the flow medium. In the case of such a pump unit, the present invention solves this problem in that the annular sealing members, which are movable relative to one another, are axially profiled on their periphery. The preferred profiling is constituted by corrugations. However, it is optionally possible also to use a sawtooth or trapezoidal profiling. The spacing of the profiling on the sealing rings, which are movable relative to one another, can vary, i.e. for example in the case of corrugated profiling of the edge, the number of corrugations on one part can vary as compared with the number of corrugations on the other part.

In the case of such a construction of the edges of the sealing rings, the profiled edge part of one of the rings should at least be substantially covered by the unprofiled part of the other ring. In an extreme case the profiled edge portions of both rings can abut. When the rear of the pump impeller is located in a cooling circuit for the motor, there should be a slight overlap of the profile of the two profiled sealing rings. As a result, part of the flow medium serving as a cooling medium can flow into the space behind the pump impeller through the openings provided periodically at points distributed over the periphery and which to a certain extent act as a sieve. Any entrained solid constituents are either forced back by the profiling or are crushed on penetrating the openings.

Figure 1:
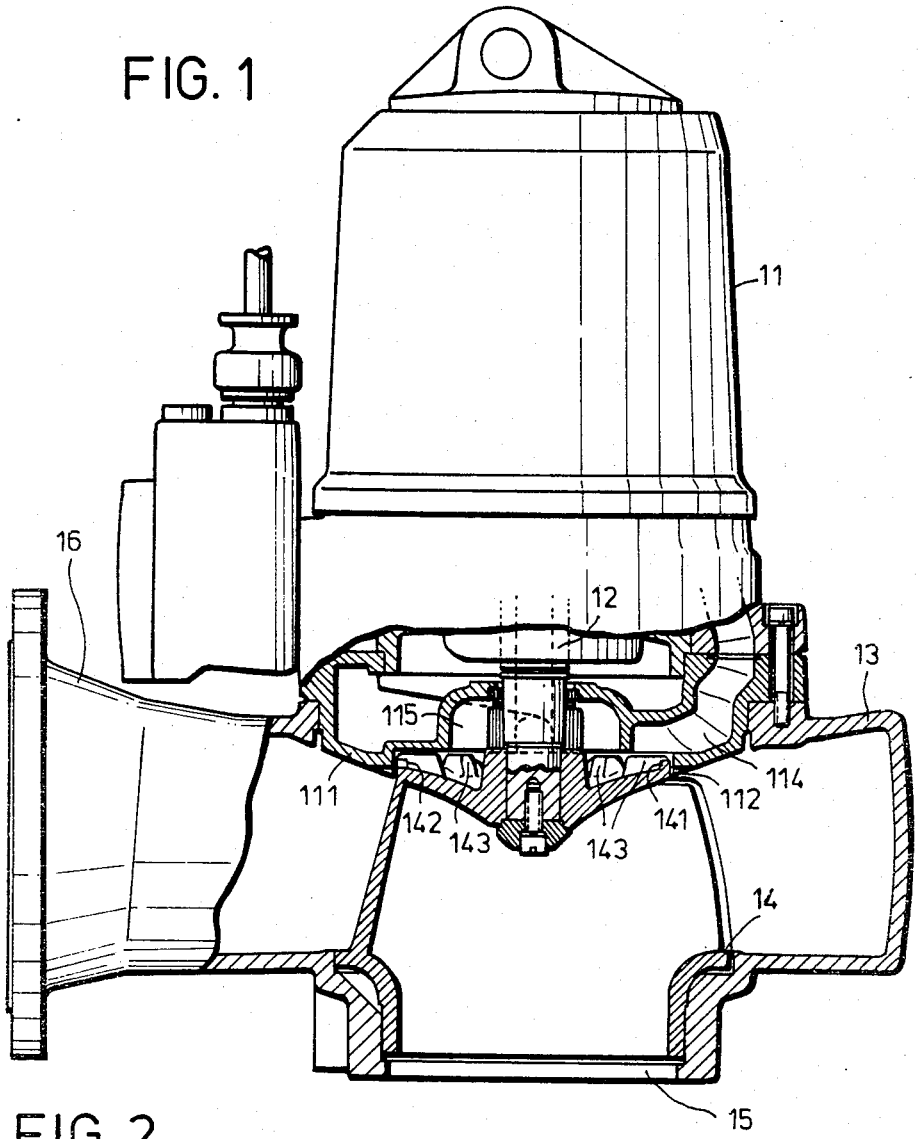
Figure 2:
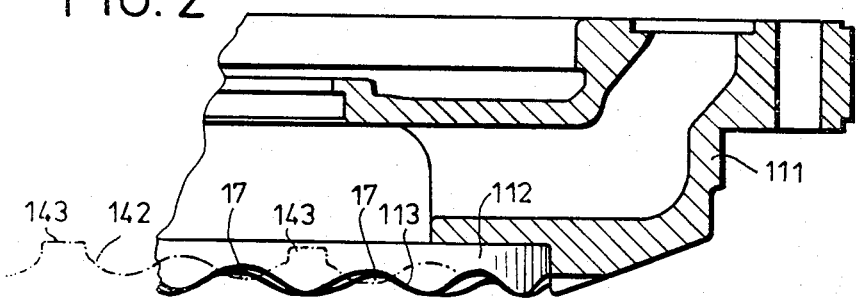

The invention will now be further described, by way of example, with reference to the drawings, in which:

FIG. 1 is a part sectional, front view of one embodiment of a unit according to the invention; and FIG. 2 shows a detail of the pump unit shown in FIG. 1 to a larger scale.

Referring to the drawings, the illustrated embodiment is biased on a known pump unit having as the drive motor an electric motor 11, whose motor shaft 12 projects into a pump casing 13 and carries and drives a pump impeller 14 located therein. The pump impeller 14 sucks the flow medium through a suction opening 15 and forces it into a feed pipe 16.

At the rear of the pump impeller 14, facing the motor 11, is provided an axially projecting annular edge 141, which co-operates with an axially projecting annular edge portion 112 on the base part 111 of the motor casing (unnumbered) in the form of a sealing ring. The base part 111 of the motor casing or chamber is shown as a larger-scale sectional detail in FIG. 2. This makes it possible to see the profiling of the annular edge or annular edge portion 112 of the base part 111. This axially projecting annular edge or ring 112 is provided on its outer edge with identical corrugations 113. The corrugation depth corresponds approximately to half the height of the ring 112. A dot-dash line 142 in FIG. 2 shows the corrugated profile of the sealing ring 141 applied to the back of the pump impeller 14. In operation, this corrugated profile moves past the sealing ring 112 and the unprofiled upper part of the ring 112 substantially covers the corrugated, outer edge portion 142 of the ring 141. Correspondingly the unprofiled part of the sealing ring 141 substantially covers the corrugations 113 of the sealing ring 112. The two corrugations overlap only by a limited amount, so that narrow openings 17 remain at a few points on the periphery and during the rotation of the pump impeller are constantly opened and closed again.

The flow medium can penetrate the space at the back of the pump impeller 14 through these openings. With the aid of rib-like projections 143 on the back of the pump impeller 14 and which act as feed elements, the flow medium which has flowed in through the openings 17 can be forced through a line 114 into a cooling circuit for the motor 11, from which it flows back again into an annulus 115. The corrugations on the sealing rings 112, 114 substantially prevent any penetration of fibrous constituents into the openings 17, which act like a sieve. Any constituents which still enter are crushed with a limited power expenditure. Admixtures to the flow medium, which could gradually build up layers on the facing surfaces of the sealing rings, are scraped off and forced away by the corrugations.

I claim:

1. A pump unit comprising a casing, a motor for rotating a shaft carrying a pump impeller, said pump impeller having an annular sealing member disposed in generally concentric and axially overlapping relationship to an annular sealing member of said casing, and said annular sealing members having cooperative means for establishing a plurality of circumferentially successively opening and closing radial flow passages upon rotation of said pump impeller through which fluid can flow radially upon the opening of each passage.

2. The pump unit as defined in claim 1 wherein said cooperative means include axially projecting corrugations upon at least one of said annular sealing members.

3. The pump unit as defined in claim 1 wherein said cooperative means include axially projecting corrugations upon at each of said annular sealing members.

4. The pump unit as defined in claim 1 wherein said cooperative means include a sawtooth or trapezoidal profiling upon at least one of said annular sealing members.

5. The pump unit as defined in claim 1 wherein said cooperative means include a sawtooth or trapezoidal profiling upon both of said annular sealing members.

6. The pump unit as defined in any one of claims 1–5 wherein there are an identical number of said cooperative means on each of said annular sealing members.

7. The pump unit as defined in any of claims 1–5 wherein there are a different number of said cooperative means on each of said annular sealing members.

8. The pump unit as defined in claim 2 or claim 3 wherein said corrugations are defined by adjoining peaks and valleys, and during the rotation of said pump impeller the valleys of one of said annular sealing members is at least substantially covered instantaneously by the peak of another of said annular sealing members.

* * * * *